US006202329B1

(12) United States Patent
Supplee et al.

(10) Patent No.: US 6,202,329 B1
(45) Date of Patent: Mar. 20, 2001

(54) APPARATUS FOR REMOVING SNOW FROM ROOFTOPS

(75) Inventors: Joseph Supplee, Bloomington; Glenn P. Willing, Excelsior, both of MN (US)

(73) Assignee: Avalanche Manufacturing, L.L.C., Minneapolis, MN (US)

( * ) Notice: Subject to any disclaimer, the term of this patent is extended or adjusted under 35 U.S.C. 154(b) by 0 days.

(21) Appl. No.: 09/088,162

(22) Filed: Jun. 1, 1998

(51) Int. Cl.[7] ..... E01H 5/02
(52) U.S. Cl. ..... 37/285; 294/54.5
(58) Field of Search ..... 294/19.1, 51, 54.5, 294/59; 37/241, 265, 266, 268, 270, 284, 285; D8/7, 10, 14

(56) References Cited

U.S. PATENT DOCUMENTS

| | | | | |
|---|---|---|---|---|
| 2,710,465 | * | 6/1955 | Timerson | 294/54.5 X |
| 3,483,643 | * | 12/1969 | Wenzel | 294/54.5 X |
| 3,958,754 | * | 5/1976 | Newcomb et al. | 237/1 R |
| 3,998,486 | * | 12/1976 | Mittelstadt | 37/285 |
| 4,089,127 | * | 5/1978 | Maijala . | |
| 4,249,767 | * | 2/1981 | Andreasen | 294/54.5 X |
| 4,252,183 | * | 2/1981 | Ricciardelli | 165/47 |
| 4,729,199 | * | 3/1988 | Oller | 52/173 R |
| 5,083,388 | * | 1/1992 | Cooley | 37/268 |
| 5,465,510 | * | 11/1995 | Goodnough et al. | 37/285 |
| 5,524,369 | * | 6/1996 | Phillips | 37/285 |
| 5,570,524 | * | 11/1996 | Groat | 37/285 |
| 5,676,413 | * | 10/1997 | Hauck | 294/54.5 |
| 5,791,707 | * | 8/1998 | Szakurski | 294/54.5 |

FOREIGN PATENT DOCUMENTS

| | | | | |
|---|---|---|---|---|
| 90509 | * | 12/1957 | (NO) | 37/285 |

* cited by examiner

*Primary Examiner*—Johnny D. Cherry
(74) *Attorney, Agent, or Firm*—Charles H. De La Garza

(57) ABSTRACT

An apparatus for removing snow from an inclined surface, including a frame member having snow-cutting legs and connected to an elongated handle member, wheels of at least 3 inches in diameter attached to the snow-cutting legs for allowing the frame member to traverse the inclined surface without being hindered by uneven terrain, a snow cutting element extending between the snow-cutting legs and disposed a predetermined distance from the inclined surface, an elongated flexible snow slide member having an end proximate the snow cutting element and a low coefficient of friction to facilitate the sliding of snow down the snow slide member when the snow slide member is disposed on the inclined surface, and a snow rake member hingedly coupled to the frame member for raking snow from the inclined surface. The snow rake member is configured to assume a retracted position when the frame member is being moved upward along the inclined surface and a raking position when the frame member is being moved downward along the inclined surface.

17 Claims, 6 Drawing Sheets

APPARATUS FOR REMOVING SNOW FROM ROOFTOPS

BACKGROUND OF THE INVENTION

I. Field of the Invention

The present invention relates to an apparatus for removing snow from an inclined surface, such as a rooftop. More particularly, the present invention relates to an improved snow removal apparatus having a snow slide assembly for cutting snow and sliding it off the inclined surface, a snow rake assembly for raking snow off the inclined surface, and improved means for allowing the snow removal apparatus to traverse along the inclined surface without being hindered by uneven terrain or obstacles such as ridges, shakes, or tiles.

II. Description of the Prior Art

The unwanted accumulation of snow on rooftops is a perennial problem in northern climates. Over the course of a winter, such snow accumulation can present a substantial weight loading problem which stresses or damages structural roof members. Damaging the structural roof members may precipitate the need for costly roof repairs. If left unattended, this damage can also lead to roof collapse thereby presenting a significant safety risk.

Snow accumulation on rooftops can also lead to the formation of problematic "ice dams" along the eaves of the structure caused by alternate heating and cooling cycles during winter days and nights. Heat absorbed by the roof surface from inside, and from the sun on the outside of the structure, causes the snow to begin melting, but no heat is present over projecting eaves, and the water from melted snow refreezes when it runs down to the projecting unheated eave surface. The resulting ice formation along the eaves soon causes water to be dammed and thereby prevents the water from running off the roof. This water can seep underneath shingles and leak into the structure, oftentimes precipitating the need for costly repairs.

The foregoing cost and safety concerns have spawned various attempts at removing snow accumulation from rooftops. One approach involves placing heating elements along the eaves of a structure so as to supplement the melting process and allow water to drain completely from the roof. Although generally effective, these heating elements are often unsightly and require service, in addition to requiring a continual cost in supplying electrical energy for heating.

Another approach involves the use of a roof rake for pulling or pushing snow off the rooftop. A roof rake typically includes a generally planar snow moving surface rigidly coupled to an elongated handle assembly. The handle assembly may be gripped by a user who is not located on the roof to pull the snow moving surface from a position on the interior of the roof towards the eaves of the roof to remove a swath of snow. A drawback exists, however, in that the user must elevate the snow moving surface far into the interior of the inclined rooftop before lowering it into the snow. The physical strain associated with repeatedly lifting and lowering of the snow moving surface in this fashion can be problematic if not prohibitive for many users.

A still further approach involves the use of a snow slide device for removing snow from rooftops. A snow slide device typically includes an elongated handle member rigidly coupled to a horizontal snow cutting element having an elongated flexible sheet extending therefrom. Wheels of reduced diameter are typically provided to space the cutting element a close distance from the surface of the rooftop during snow removal. The handle assembly may be gripped by a user who is not located on the roof to push the snow cutting element up the rooftop. As the snow cutting element traverses up the rooftop, a swath of snow is cut out which slides off the roof under the force of gravity along the elongated flexible sheet coupled to the cutting element.

Snow slide devices are generally advantageous in that they allow users to simply push the cutting element under the snow without the need to engage in the repeated lifting and lowering required with roof rakes. However, the snow slide devices of the prior art lack the ability to remove snow from corner areas or angled sections on rooftops, as can be accomplished with roof rakes. Moreover, the wheels employed to space the cutting element off the surface of the rooftop are disadvantageously small and unable to negotiate uneven terrain or obstacles on rooftops such as ridges, shakes, or tiles. This can result in unwanted damage to the rooftop materials, possibly in the form of chipping or marring of the ridges, shakes, or tiles when the small wheels are unable to pass thereover.

What is needed, therefore, is an improved apparatus for removing snow from rooftops which solves the aforementioned drawbacks in the prior art.

SUMMARY OF THE INVENTION

The present invention solves the aforementioned deficiencies in the prior art by providing an improved snow removal apparatus having a snow slide assembly for cutting snow and sliding it off the inclined surface, a snow rake assembly for raking snow off the inclined surface, and improved means for allowing the snow removal apparatus to traverse along the inclined surface without being hindered by uneven terrain or obstacles such as ridges, shakes, or tiles.

An elongated handle member is provided having a generally U-shaped frame rigidly attached at one end. The U-shaped frame includes a generally horizontal middle portion coupled generally perpendicularly to the end of the handle member. The U-shaped frame also includes generally vertical leg portions depending downwardly and angularly away from the middle portion. In one embodiment, wheels of increased diameter are provided on each of the leg portions as means for allowing the improved snow removal apparatus to traverse along the inclined surface without being hindered by uneven terrain or obstacles such as ridges, shakes, or tiles. This advantageously reduces the risk of damaging the roof materials, such as ridges, shakes, or tiles.

The snow slide assembly comprises a snow cutting element and an elongated flexible sheet. The snow cutting element is preferably a rod member extending between the opposing leg portions of the U-shaped frame near the ends thereof. The elongated flexible sheet is coupled to the snow cutting element at one end and extends longitudinally away in a generally co-aligned fashion with the handle member. During use, the user need only manipulate the handle member to slide the apparatus upwardly along the surface of the rooftop. The cutting element is spaced a predetermined distance from the rooftop and cuts under the snow to allow the snow to slide under the force of gravity off the rooftop along the elongated flexible sheet. In a preferred embodiment, the wheels of increased dimension are disposed in an offset relation to the cutting element, with the wheels located a predetermined distance above the cutting element, such that the cutting element is maintained in close proximity to the surface to be cleared.

The roof rake assembly includes a snow rake member retractably coupled to the U-shaped frame. When the user is pushing the apparatus upwards along the surface of the rooftop, the snow rake member is in a retracted position so as not to interfere with or impede the upward progress of the apparatus. Once the apparatus has been pushed to the inner portion of the rooftop, the snow rake member can be deployed into a raking position which allows the user to pull the apparatus downward along the rooftop and rake snow therefrom.

In one embodiment, the snow rake member comprises a generally rigid planar member hingedly coupled to the U-shaped frame toward the upper region of the leg portions. The hinged coupling allows the snow rake member to extend rearward toward the user, generally parallel to the surface of the rooftop, while the apparatus is being pushed upwardly along the rooftop. Once the upward progression of the apparatus is ceased, the snow rake member can be lowered into the raking position under the force of gravity and/or by jiggling the apparatus back and forth, after which point the user may pull the apparatus back down the rooftop to rake snow therefrom.

In an important aspect of the present invention, the snow slide assembly and the snow rake assembly can be used in combination or separately, thus providing a user with great flexibility in addressing the types of snow accumulation that may be present. For example, it may be useful when removing heavy, wet snow from rooftops to employ the snow removal capabilities of both the snow slide assembly and the snow rake assembly. The snow slide assembly can effectively form a cut along the lower portion of the snow and, while heavy and wet snow may not otherwise readily slide down the flexible sheet, the snow rake may be engaged to pull the snow off the rooftop on top of the flexible sheet. If the task at hand only requires a raking action, such as when removing snow from corner areas or angled portions on the rooftop, the snow slide assembly can be easily detached from the U-shaped frame to avail only the snow raking capabilities of the apparatus.

The improved snow removal apparatus of the present invention is not only advantageous in terms of providing great flexibility in removing snow, but also in the ease with which a user may operate the apparatus to effectuate snow removal. Whether engaging in a snow sliding function or a snow raking function, the apparatus of the present invention can be easily manipulated upward and downward along the surface of the rooftop without the need to lift and lower the snow removal apparatus as required with conventional roof rakes. The present invention thusly minimizes the energy required to effectively remove snow from rooftops, thereby allowing users of all ages and builds to success filly engage in rooftop snow removal.

The present invention is also advantageous in terms of the improved traversal means for allowing the snow removal apparatus to traverse along the inclined surface without being hindered by uneven terrain or obstacles such as ridges, shakes, or tiles. Specifically, the improved traversal means, which in a preferred embodiment comprise wheel members of increased dimension, eliminate the risk of damaging the roof materials during use as found with prior art systems having wheels of reduced diameter.

BRIEF DESCRIPTION OF THE DRAWING

A preferred embodiment of the present invention is described herein and is illustrated in the attached drawings in which.

DESCRIPTION OF THE PREFERRED EMBODIMENT

Figure 1:
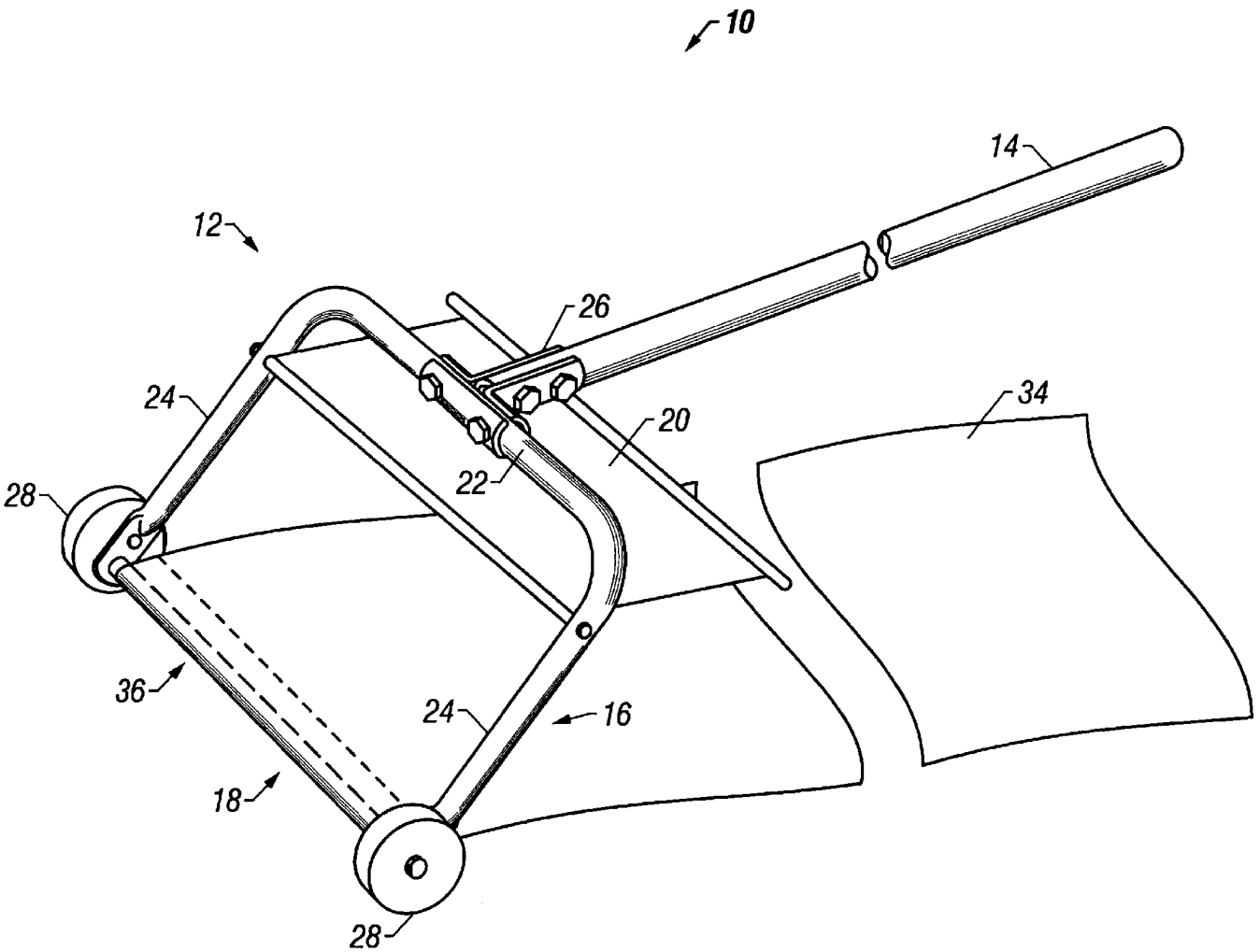
FIG. 1 is a perspective view of the improved snow removal apparatus in accordance with a preferred embodiment of the invention.

Referring to FIG. 1, shown is an improved snow removal apparatus 10 according to a preferred embodiment of the present invention. The improved apparatus 10 includes a snow removal assembly, designated generally at 12, coupled to an elongated handle member 14. The handle member 14 allows a user to selectively direct the snow removal assembly 12 along a snow-laden inclined surface, such as a rooftop, for the purpose of snow removal. In one embodiment, the snow removal assembly 12 includes a generally U-shaped frame 16, a snow slide assembly 18, and a snow rake member 20. As will be set forth in greater detail below, the snow slide assembly 18 provides the ability to slide snow off the inclined surface, while the snow rake member 20 provides the ability to rake snow off the inclined surface. The snow slide assembly 18 and the snow rake member 20 collectively provide a user great flexibility in addressing the various challenges involved in rooftop snow removal.

The U-shaped frame 16 includes a generally horizontal middle portion 22 and generally vertical leg portions 24 depending downwardly and angularly away from either end of the middle portion 22. The middle portion 22 is coupled generally perpendicularly to the handle member 14 by means of a suitable connecting bracket 26. The U-frame 16 is preferably constructed from a resilient tubular material, although the vertical leg portions 24 may be flattened to reduce the resistance of moving the apparatus through a snow accumulation by creating more of a knife-edge surface. The U-frame 16 and bracket 26 may alternately be formed of suitable plastic in a single-piece mold operation. The U-frame 16 is typically 18–30 inches in width, although it may be wider, to provide a snow removal path of reasonable size.

The handle member 14 may be constructed from an aluminum or fiberglass tube or from any other material adapted to have strength over an elongated length. The handle member 14 may be 10 to 20 feet or more in length depending upon the nature and size of the roof the invention is used with and may be assembled with interlocking or attaching tubular sections. For convenience and cost savings, the snow removal assembly 12 may be offered to users separately as a retro-fit assembly such that the handle member 14 may comprise the handle member of prior art snow removal devices already owned by the user.

Figure 7:
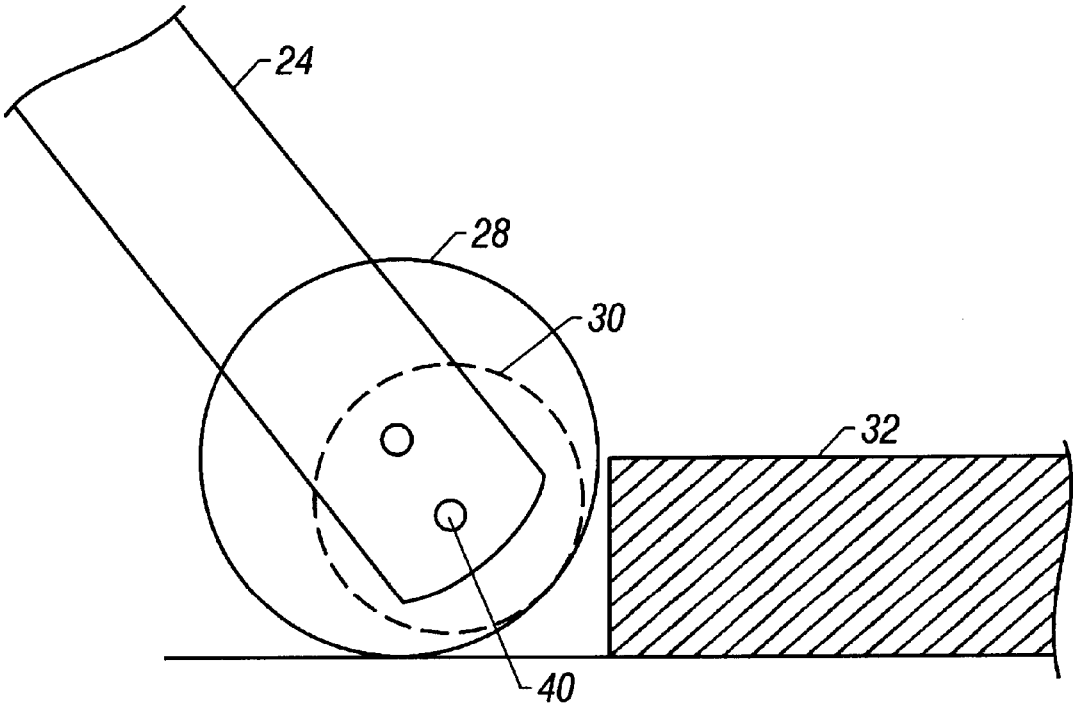
FIG. 7 is a side view of an enlarged wheel member for allowing the snow removal apparatus to negotiate the rooftop without being hindered by uneven terrain or obstacles.

In an important aspect of the present invention, the leg portions 24 of the U-frame 16 are equipped with improved traversing means for allowing the snow removal apparatus 10 to traverse along a rooftop without being hindered by uneven terrain or obstacles such as ridges, shakes, or tiles. In one embodiment, the improved traversing means includes a pair of wheel members 28 rotatably coupled to the leg portions 24. With brief reference to FIG. 7, each wheel member 28 is of substantially increased dimension, preferably at least 3 inches in diameter, relative to the 1½ inch diameter wheel members (shown in phantom at 30) employed in prior art snow slide devices. In this fashion, each wheel member 28 is capable of negotiating obstacles, such as a shake 32, which would otherwise impede the wheel members 30 of the prior art. Alternately, the wheel members 28 could be replaced by a simple pair of runners or other glide surface, so long as the glide surface has a sufficiently angled front end for sliding over rooftop obstacles such as the shake 32.

The snow slide assembly 18 includes an elongated flexible sheet 34 and a snow cutting element 36 extending generally horizontally between the leg portions 24. The snow cutting element 36 is disposed a predetermined distance above the surface of the rooftop for forming a cut underneath a depth of snow when the apparatus 10 is moved upwardly along a snow-laden rooftop. The flexible sheet 34 extends from the cutting element 36 such that the snow, having been cut by the cutting element 36, may slide off the rooftop under the component force ("F" in FIGS. 2 and 3) of gravity ("W" in FIGS. 2 and 3) that is parallel to the rooftop.

The flexible sheet 34 is preferably formed of a plastic material such as polyethylene, of thickness 0.002 inch–0.010 inch, and having a length of at least several feet. In one embodiment, the sheet 34 may be made 10–15 feet long, or longer, such that it will overhang the lower roof edge as the apparatus 10 is moved upward along the roof surface. The surface of sheet 34 is preferably of a low coefficient of friction, for example less than 0.2, which presents a slippery surface to cause snow to readily slide over the surface of sheet 34. Plastic sheet material is commercially available having a reinforcing filament embedded therein, and this type of plastic sheet material may be used to provide additional strength against tearing of the sheet.

The cutting element 36 preferably takes the form of a rod member (not shown) disposed within a receiving portion formed along one end of the flexible sheet 34. The rod member couples the flexible sheet 34 to the U-frame 16 and provides a low profile yet rigid structure for forming a cut underneath a depth of snow. The receiving portion of the sheet 34 may be formed by attaching a length thereof around the rod member by sewing, glueing, or thermally bonding according to practices known in the art.

Figure 8:
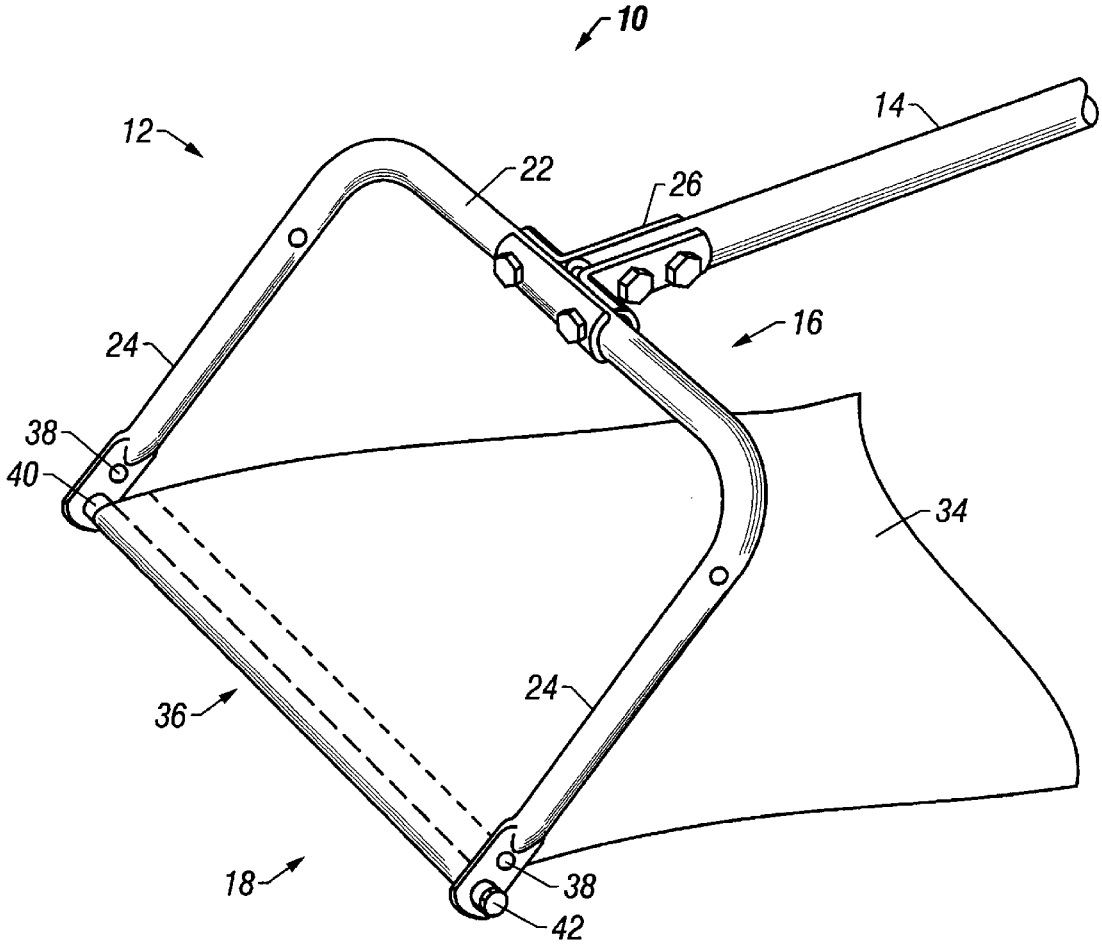
FIG. 8 is a side view illustrating the manner of detaching the snow slide assembly from the snow removal apparatus.

The rod member is preferably removable from U-frame 16. With reference to FIG. 8, this can be accomplished by removing the wheel members 28 from upper apertures 38 formed in the leg portions 24, and then removing the rod member 40 from lower apertures formed in the leg portions 24. Providing the rod member 40 in this fashion permits the attachment of a new sheet 34 when excessive wear occurs. As will be explained in greater detail below, it also provides the ability to remove the snow slide assembly 18 such that the improved snow removal apparatus 10 of the present invention can be used with the snow rake member 20 only. This may be advantageous when removing snow from corner areas or angled portions of a rooftop where the snow slide assembly 18 may be otherwise ineffective at removing snow.

The rod member 40 is also preferably rotatably disposed between the leg portions 24 such that the flexible sheet 34 may be rolled up for storage on the rod member 40. In one aspect of the present invention, this task may be facilitated by providing means for winding or rotating the rod member 40 which enables a user to quickly and easily roll up the sheet 34 on the rod member 40 for storage. With continued reference to FIG. 8, the means for winding may take the form of a drill bit attachment 42 disposed at one end of the rod member 40. In this arrangement, a user can simply place an electric drill having a mating bit over the drill bit attachment 42 to quickly and efficiently roll up the flexible sheet 34 to ready the apparatus 10 for storage. The drill bit attachment 42 may be configured in any number of common drill bit shapes such that commercially available drill bits may be employed. These drill bit shapes include, but not limited to, a hexagon-type head for mating with a female hexagon-type bit, a Phillips screw driver head for mating with a Phillips screw driver bit, a regular screw driver head for mating with a regular screw driver bit, and an Allen wrench-type head for mating with an Allen wrench-type bit. These bit shapes may be formed as an integral part of the rod member 40 or, alternatively, may be separate bit attachments rigidly coupled to the rod member 40.

Figure 2:
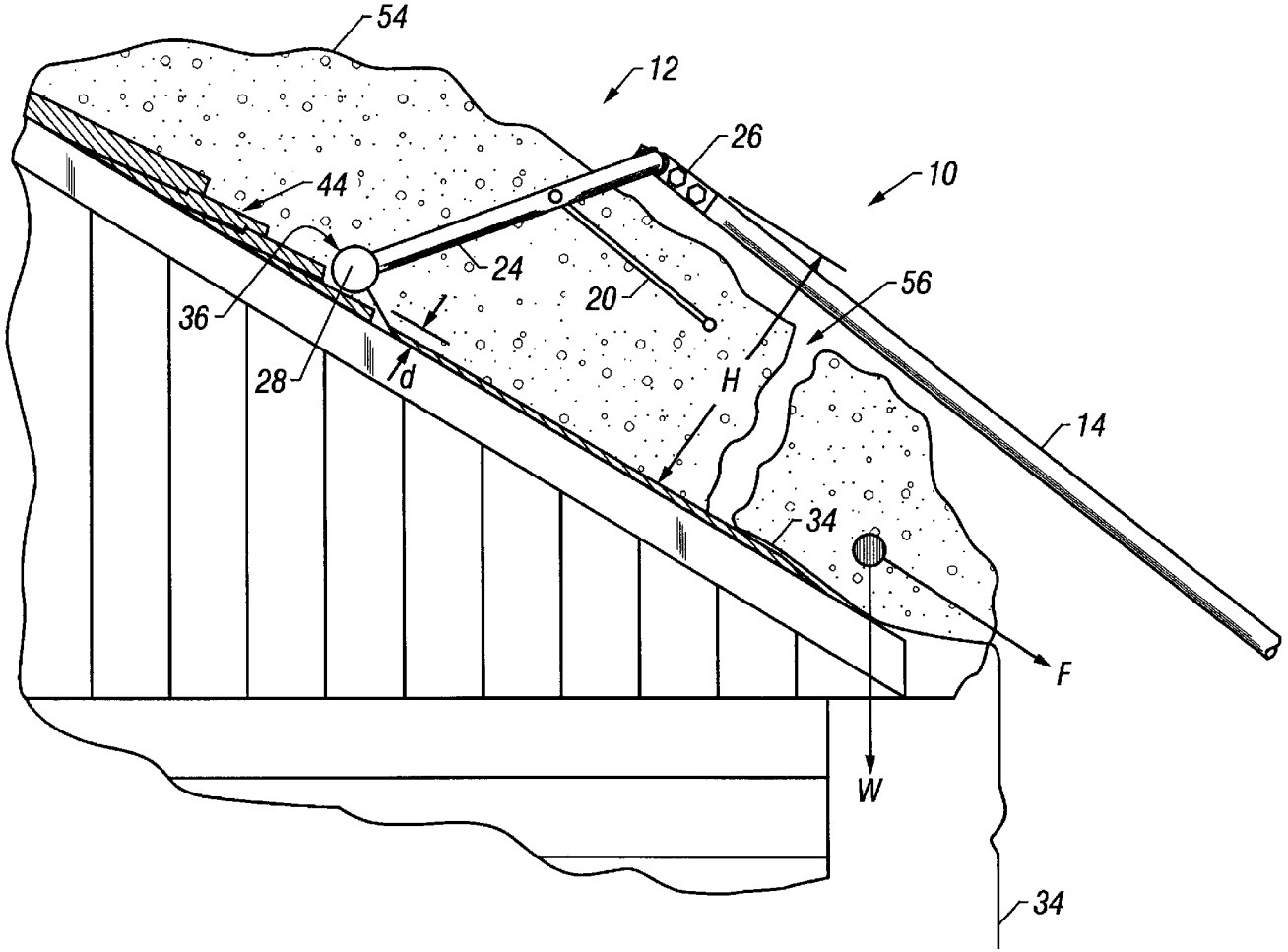
FIG. 2 is a side view of the improved snow removal apparatus during traverse upward along a snow-laden rooftop.
Figure 3:
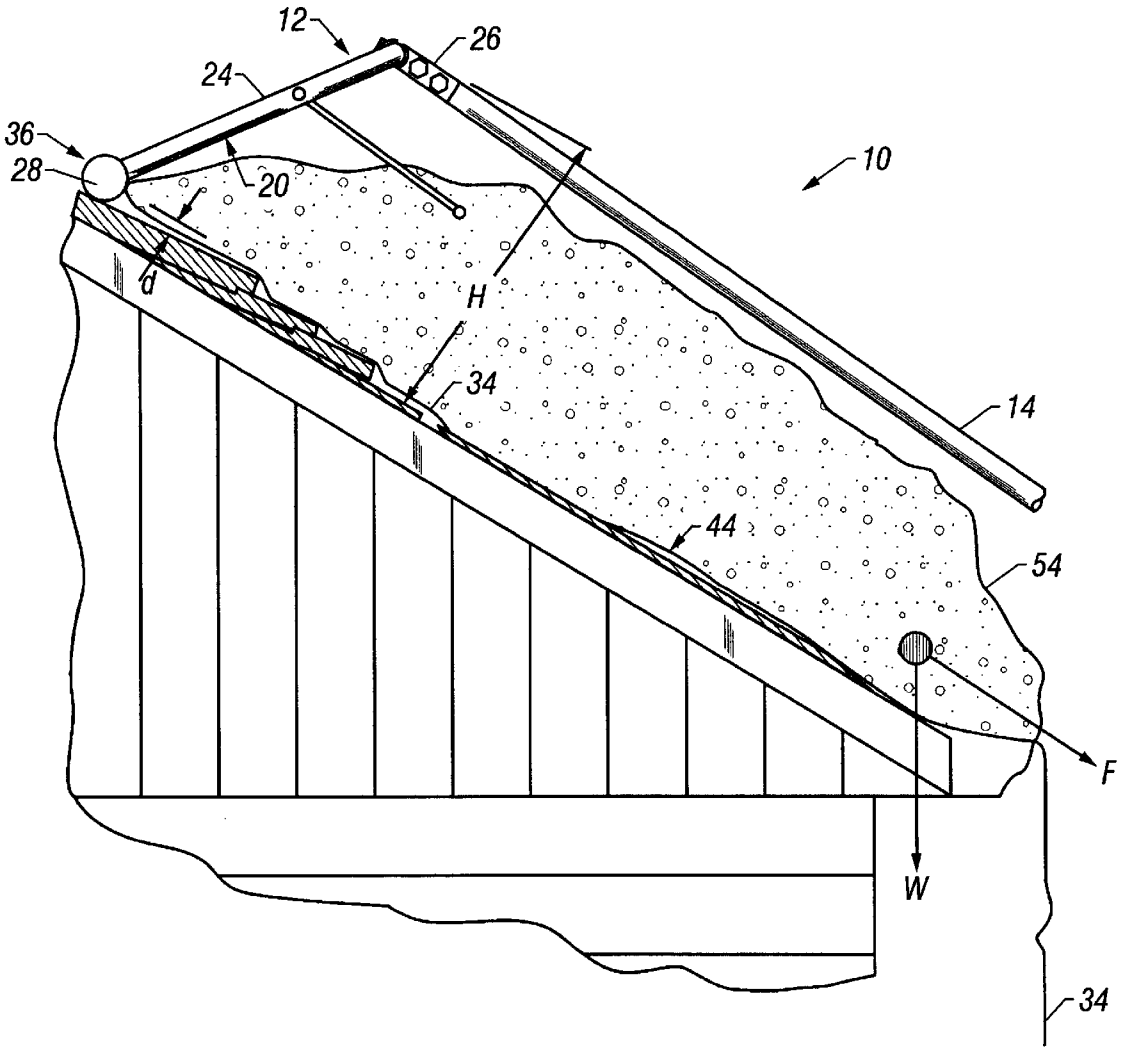
FIG. 3 is a side view of the improved snow removal apparatus during traverse downward along a snow-laden rooftop.

With reference to FIG. 1, the snow rake member 20 is hingedly coupled between the leg portions 24 such that it can be disposed in a generally horizontal retracted position or a generally vertical raking position. The snow rake member 20 is generally rectangular in shape and dimensioned such that, when in the raking position, it extends substantially the width of the leg portions 24 to form a plowing surface. As shown in FIG. 2, when a user is pushing the apparatus 10 upwards along the surface of the rooftop 44, the snow rake member 20 is in the retracted position and therefore does not interfere with or impede the upward progress of the snow removal apparatus 10. Referring to FIG. 3, once the snow removal apparatus 10 has been pushed to the inner portion of the rooftop 44, the snow rake member 20 can be deployed into the raking position which allows the user to pull the apparatus 10 downward along the rooftop 44 and rake snow therefrom. The snow rake member 20 can be lowered into the raking position under the force of gravity and/or by jiggling the snow removal apparatus 10 back and forth.

Figure 4:
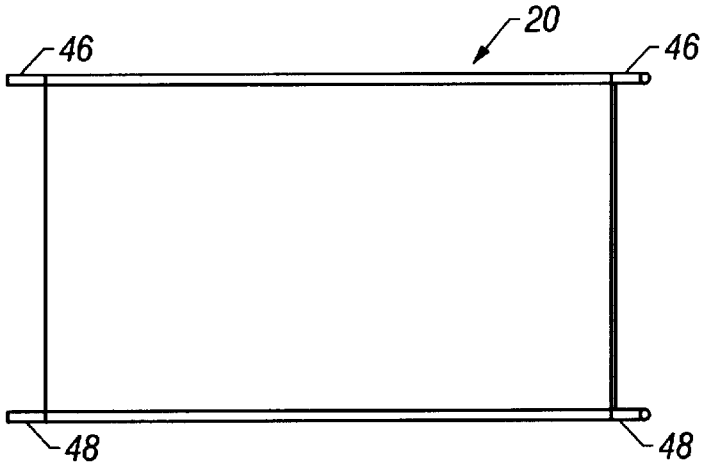
FIG. 4 is a front view of a snow rake member according to one embodiment of the present invention.
Figure 5:
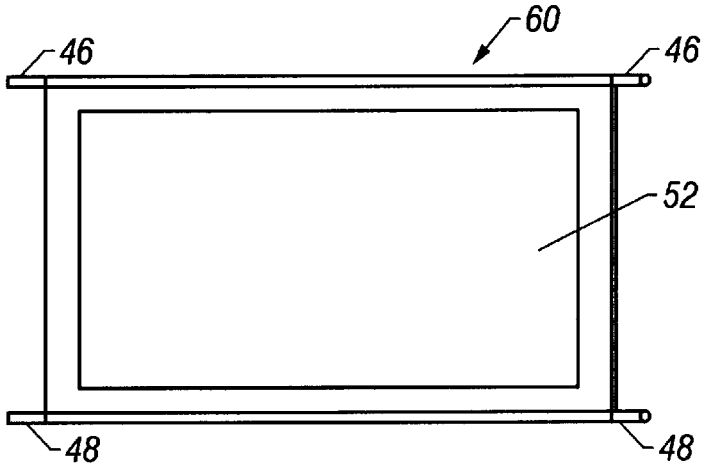
FIG. 5 is a front view of a snow rake member according to another embodiment of the present invention.
Figure 6:
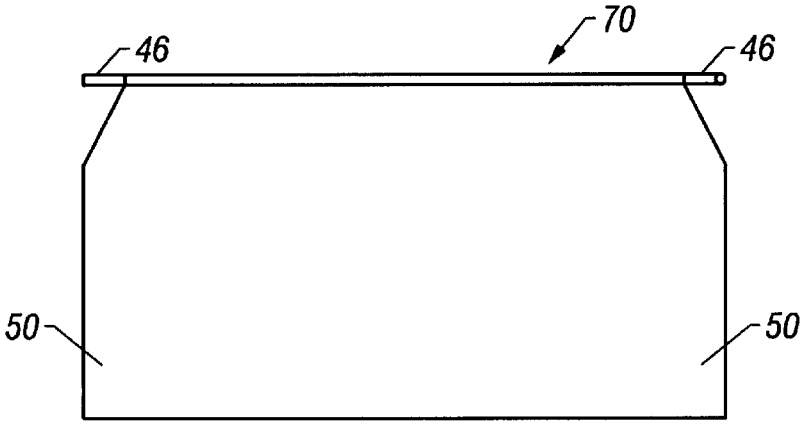
FIG. 6 is a front view of a snow rake member according to another embodiment of the present invention.

The snow rake member 20 may take a variety of different forms, including but not limited to those shown in FIGS. 4–6 (The snow rake member is references with numeral "60" in FIG. 5 and "70" in FIG. 6). In each embodiment, a pair of cylindrical posts 46 extend horizontally away from the upper edge of the snow rake member 20, 60 or 70, respectively. These upper cylindrical posts 46 rotatably engage within apertures formed in the leg portions 24 which, as noted above, allows the snow rake member, 60 or 70, respectively, to hingedly rotate between a retracted position (FIGS. 1 and 2) and a raking position (FIG. 3). As shown in FIGS. 4 and 5, the snow rake member 20 or 60, respectively, may be provided with another pair of cylindrical posts 48 extending horizontally away from the lower edge. These lower cylindrical posts 48 extend a length sufficient to abut against the leg portions 24 when the snow rake member 20 or 60, respectively, is in the raking position so as to maintain the snow rake member 20 or 60, respectively in a generally rigid state when raking snow off the rooftop. Referring to FIG. 6, this can also be accomplished by extending the side areas 50 of the snow rake member 70 outwardly relative to the embodiments shown in FIGS. 4 and 5.

The snow rake member 20, 60 or 70 is preferably formed of a generally rigid material, such as plastic or metal. As shown in FIG. 5, the snow rake member 60 may be manufactured with a light-weight material 52 within the center area to reduce the overall weight of the snow rake member 60. The light weight material 52 may include any of a variety of materials, including but not limited to plastic, canvas, or weather-resistant synthetic cloth.

FIG. 2 illustrates the improved snow removal apparatus 10 of the present invention in side view on a rooftop 44 to demonstrate the snow removal capability of the snow slide assembly 18. The top of U-frame 16 has a vertical height H above rooftop 44 sufficient to pass over any reasonable snow accumulation depth. A height H of 12 inches has been found satisfactory for most purposes. U-frame 16 is propelled upwardly along rooftop 44, with the wheels 28 rolling along the roof surface, by applying upward force to handle member 14. This causes the snow cutting element 36 to undercut the snow accumulation 54 and to slide sheet 34 under snow accumulation 54. Under normal conditions, as U-frame 16 is pushed upwardly a snow accumulation fracture 56 occurs. Since sheet 34 is selected from materials having very low coefficient of friction, a gravitational sliding force will cause the snow resting on sheet 34 to slide downwardly off the edge of the roof.

The snow cutting element 36 preferably undercuts a snow accumulation at a depth d which, in the preferred embodiment, corresponds to the height of the rod member 40 above the roof surface. This height is typically about ½–2 inches and results in a very thin layer of snow accumulation being left on the roof. It has been found that this thin snow layer is of no harmful consequence and is usually dissipated by sublimation, melting or blowing after only a short period of time.

FIG. 3 illustrates the improved snow removal apparatus 10 of the present invention in side view on the rooftop 44 to demonstrate the snow removal capability of the snow rake member 20. After the snow removal apparatus 20 has been pushed upward into the inner region of the rooftop 44, the snow rake member 20 can be lowered into the raking position under the force of gravity and/or by jiggling the apparatus 10 back and forth, after which point the user may pull the apparatus 10 back down the rooftop to rake snow therefrom. The snow rake member 20 preferably undercuts the snow accumulation at a depth d which corresponds to the height of the lower edge of the snow rake member 20 above the roof surface. As with the snow cutting element 36 of the snow slide assembly 18, this height is typically about ½–2 inches and results in a very thin layer of snow accumulation being left on the roof. It has been found that this thin snow layer is of no harmful consequence and is usually dissipated by sublimation, melting or blowing after only a short period of time.

In an important aspect of the present invention, the snow slide assembly 18 and the snow rake member 20 can be used in combination or separately, thus providing a user with great flexibility in addressing the types of snow accumulation that may be present. It may be useful when removing heavy, wet snow from rooftops to employ the snow removal capabilities of both the snow slide assembly 18 and the snow rake member 20. In this arrangement, the snow slide assembly can effectively form a cut along lower portion of the snow and, while heavy and wet snow may not otherwise readily slide down the flexible sheet 34, the snow rake may be engaged to pull the snow off the rooftop on top of the flexible sheet 34. On the other hand, if the snow removal task only requires a raking action, such as when removing snow from corner areas or angled portions on the rooftop, the snow slide assembly 18 can be easily detached from the U-shaped frame 16 to avail only the snow raking capabilities of the improved snow removal apparatus 10 of the present invention.

The improved snow removal apparatus 10 of the present invention is also advantageous by increasing the ease with which a user may operate the apparatus to effectuate snow removal. Whether engaging in a snow sliding function or a snow raking function, the snow removal apparatus 10 of the present invention can be easily manipulated upward and downward along the surface of the rooftop without the need to lift and lower the snow removal apparatus 10 as required with conventional roof rakes. The present invention thereby minimizes the energy required to effectively remove snow from rooftops, allowing users of all ages and builds to successfully engage in rooftop snow removal.

The present invention is also advantageous in that the wheel members 28, having an increased dimension relative to wheels of prior art snow removal devices, allow the improved snow removal apparatus 10 to traverse along the inclined surface without being hindered by uneven terrain or obstacles such as ridges, shakes, or tiles.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the invention is to cover all modifications, equivalents, and alternative falling within the spirit and scope of the invention as defined by the appended claims.

What is claimed is:

1. An apparatus for removing snow from an inclined surface, comprising:

a frame member having snow-cutting legs in spaced relation extending generally downward, said frame member being coupled to an elongated handle member such that said frame member can be selectively moved upwards and downwards along an inclined surface;

traversal means for allowing said frame member to traverse the inclined surface without being hindered by uneven terrain, said traversal means being coupled to said snow-cutting legs;

snow slide means coupled to said frame member for sliding snow off an inclined surface, said snow slide means including a snow cutting element and an elongated flexible snow slide member, said snow cutting element extending between said snow-cutting legs and disposed a predetermined distance from said inclined surface, said snow slide member having an end disposed proximate said snow cutting element and a low coefficient of friction to facilitate the sliding of snow down said snow slide member when said snow slide member is disposed on said inclined surface; and a snow rake member hingedly coupled to said frame member for raking snow from said inclined surface, said snow rake member being configured to assume a retracted position when said frame member is being moved upward along said inclined surface and a raking position when said frame member is being moved downward along said inclined surface.

2. The apparatus of claim 1 and further, said traversal means comprising wheel members coupled to said snow-cutting legs, said wheel members each having a diameter sufficient to allow said frame member to traverse said inclined surface without being hindered by uneven terrain.

3. The apparatus of claim 2 and further, wherein said wheel members are disposed a predetermined distance above said snow cutting element so as to maintain said snow cutting element a predetermined distance from said inclined surface.

4. The apparatus of claim 3 and further, said snow slide member comprising a length of polyethylene plastic having a surface coefficient of friction of less than 0.2.

5. The apparatus of claim 2 and further, wherein each of said wheel members has a diameter of at least 3 inches.

6. The apparatus of claim 1 and further, said snow cutting element comprising a rod member rotatably disposed between said snow-cutting legs.

7. The apparatus of claim 6 and further, said snow slide member having a receiving portion formed at one end thereof for receiving said rod member therein to couple said snow slide member to said frame member.

8. The apparatus of claim 6 and further, said rod member having means for rotating said rod member to thereby roll up said snow slide member on said rod member.

9. An apparatus for removing snow from an inclined surface, comprising:

a frame member having snow-cutting legs in spaced relation extending generally downward, said frame member being coupled to an elongated handle member such that said frame member can be selectively moved upwards and downwards along an inclined surface;

traversal means for allowing said frame member to traverse the inclined surface without being hindered by uneven terrain, said traversal means being coupled to said snow-cutting legs;

snow slide means coupled to said frame member for sliding snow off an inclined surface, said snow slide means including a snow cutting element and an elongated flexible snow slide member, said snow cutting element extending between said snow-cutting legs and disposed a predetermined distance from said inclined surface, said snow slide member having an end disposed proximate said snow cutting element and a low coefficient of friction to facilitate the sliding of snow down said snow slide member when said snow slide member is disposed on said inclined surface; and a snow rake member hingedly coupled to said frame member for raking snow from said inclined surface, said snow rake member being configured to assume a retracted position when said frame member is being moved upward along said inclined surface and a raking position when said frame member is being moved downward along said inclined surface;

said snow cutting element comprising a rod member rotatable disposed between said snow-cutting legs;

said rod member having means for rotating said rod member to thereby roll up said snow slide member on said rod member;

said means for rotating including a drill bit attachment attached to said rod member.

10. An apparatus for removing snow from an inclined roof surface, comprising:

a frame member having two substantially vertical snow cutting arms and means for attaching an elongated handle to said frame member;

a snow slide assembly removably coupled to said frame member for selectively sliding snow off an inclined roof surface, said snow slide assembly including a snow cutting element and a snow slide element, said snow cutting element extending generally horizontally between said snow cutting arms and spaced a predetermined distance above said inclined roof surface, said snow slide element being disposed proximate to said snow cutting element for sliding snow off said inclined roof surface when said frame member is moved upward along said inclined roof surface;

a snow rake coupled to said frame member for raking snow off said inclined roof surface when said frame member is moved downward along said inclined roof surface; and a pair of wheel members rotatably coupled to said snow cutting arms, said wheel members each having a diameter of at least 3 inches, said wheel members being disposed above said snow cutting element to maintain said snow cutting element a predetermined distance from said inclined roof surface.

11. The apparatus of claim 10 and further, said snow slide element comprising a length of polyethylene plastic having a surface coefficient of friction of less than 0.2.

12. The apparatus of claim 10 and further, said snow cutting element comprising a rod member rotatably disposed between said snow cutting arms.

13. The apparatus of claim 12 and further, said snow slide element having a receiving portion formed at one end thereof for receiving said rod member therein to couple said snow slide element to said frame member.

14. The apparatus of claim 12 and further, said rod member having means for rotating said rod member to thereby roll up said snow slide element on said rod member.

15. An apparatus for removing snow from an inclined roof surface, comprising:

a frame member having two substantially vertical snow cutting arms and means for attaching an elongated handle to said frame member;

a snow slide assembly removably coupled to said frame member for selectively sliding snow off an inclined roof surface, said snow slide assembly including a snow cutting element and a snow slide element, said snow cutting element extending generally horizontally between said snow cutting arms and spaced a predetermined distance above said inclined roof surface, said snow slide element being disposed proximate to said snow cutting element for sliding snow off said inclined roof surface when said frame member is moved upward along said inclined roof surface;

a snow rake coupled to said frame member for raking snow off said inclined roof surface when said frame member is moved downward along said inclined roof surface; and a pair of wheel members rotatably coupled to said snow cutting arms, said wheel members each having a diameter of at least 3 inches, said wheel members being disposed above said snow cutting element to maintain said snow cutting element a predetermined distance from said inclined roof surface;

said snow cutting element comprising a rod member rotatably disposed between said snow cutting arms;

said rod member having means for rotating said rod member to thereby roll up said snow slide element on said rod member;

said means for rotating including a drill bit attachment attached to said rod member.

16. An apparatus for removing snow from an inclined roof surface, comprising:

a frame member having two substantially vertical snow cutting arms and means for attaching an elongated handle to said frame member;

a snow slide assembly removably coupled to said frame member for selectively sliding snow off an inclined roof surface, said snow slide assembly including a snow cutting element and a snow slide element, said snow cutting element extending generally horizontally between said snow cutting arms and spaced a predetermined distance above said inclined roof surface, said snow slide element being disposed proximate to said snow cutting element for sliding snow off said inclined roof surface when said frame member is moved upward along said inclined roof surface;

a snow rake coupled to said frame member for raking snow off said inclined roof surface when said frame member is moved downward along said inclined roof surface; and a pair of wheel members rotatably coupled to said snow cutting arms, said wheel members each having a diameter of at least 3 inches, said wheel members being disposed above said snow cutting element to maintain said snow cutting element a predetermined distance from said inclined roof surface;

said snow rake including a generally rigid outer periphery and an inner portion for receiving a light weight snow barrier therein.

17. An apparatus for removing snow from an inclined roof surface, comprising:

a frame member having a pair of downwardly depending snow cutting members, the frame member having an attachment for an elongated handle member;

a snow cutting element coupled to said snow cutting members for forming a cut underneath a depth of snow when said frame member is moved along said inclined roof surface;

a snow slide having a first end positioned in close proximity to said snow cutting element and a second end extending a predetermined distance therefrom;

a pair of wheel members rotatably coupled to said snow cutting members, each of said wheel members having a diameter of at least 3 inches; and a snow rake hingedly coupled between said snow cutting members for raking snow off said inclined roof surface as said frame member is moved downward along said inclined roof surface.

* * * * *